US005677965A

United States Patent [19]

Moret et al.

[11] Patent Number: 5,677,965

[45] Date of Patent: Oct. 14, 1997

[54] INTEGRATED CAPACITIVE TRANSDUCER

[75] Inventors: Jean-Marc Moret, Cortaillod; Johan Wilhelm Bergqvist, Bôle, both of Switzerland

[73] Assignee: CSEM Centre Suisse d'Electronique et de Microtechnique, Switzerland

[21] Appl. No.: 309,329

[22] Filed: Sep. 20, 1994

Related U.S. Application Data

[63] Continuation of Ser. No. 114,167, Sep. 1, 1993, abandoned.

[30] Foreign Application Priority Data

Sep. 11, 1992 [FR] France ..... 92 10947

[51] Int. Cl.[6] ..... H04K 25/00

[52] U.S. Cl. ..... 381/191; 381/174; 381/113

[58] Field of Search ..... 381/174, 191, 381/113, 116; 310/332, 328; 367/181, 170

[56] References Cited

U.S. PATENT DOCUMENTS

| | | | |
|---|---|---|---|
| 4,524,247 | 6/1985 | Lindenberger et al. . | |
| 4,533,795 | 8/1985 | Baumhauer, Jr. et al. . | |
| 4,542,264 | 9/1985 | Schmidt et al. . | |
| 4,908,805 | 3/1990 | Sprenkels et al. | 381/174 |
| 4,910,840 | 3/1990 | Sprenkels et al. . | |
| 4,993,072 | 2/1991 | Murphy . | |
| 5,208,789 | 5/1993 | Ling . | |
| 5,248,912 | 9/1993 | Zdeblick et al. . | |

FOREIGN PATENT DOCUMENTS

| | | |
|---|---|---|
| 2 212 026 | 7/1989 | United Kingdom . |
| 83/01362 | 4/1983 | WIPO . |
| 85/00495 | 1/1985 | WIPO . |

OTHER PUBLICATIONS

"Development of an electret microphone in silicon", A.J. Sprenkels et al., Journal of Sensors and Actuators, 17(1989), pp. 509–512.

"Fowler–Nordheim Tunneling Into Thermally Grown $SiO_2$", M. Lenzlinger and E.H. Snow, Journal of Applied Physics, vol. 40, No. 1, Jan. 1969, pp. 278–283 and 515.

English Translation of Search Report in priority French Application No. 92 10947.

*Primary Examiner*—Sinh Tran

*Attorney, Agent, or Firm*—Pollock, Vande Sande & Priddy R.L.L.P.

[57] ABSTRACT

An integrated capacitive transducer (1) which includes a membrane having a movable part (4) with an electrode, a fixed plate (6) with a counter-electrode (8), and an electrode and counter-electrode support structure (10). The fixed plate (6) also has an electret (30) which is disposed facing the movable part (4), is separated from the membrane by an open space (16), and has a first electrically conductive layer (32) embedded in an insulating material (34, 36). The invention has particular applications in hearing aids.

16 Claims, 3 Drawing Sheets

INTEGRATED CAPACITIVE TRANSDUCER

This is continuation application of Ser. No. 08/114,167, filed on Sep. 1, 1993 now abandoned.

FIELD OF THE INVENTION

The invention relates to an integrated capacitive transducer and, more specifically, to a transducer of this type provided with an electret in which the electret has excellent charge retention and in which the distribution of the charge is homogenous. Transducers of this type are notably intended for use as a microphone for hearing aids.

BACKGROUND OF THE INVENTION

Commonly used transducers or microphones mainly consist of transducers of the capacitive, piezo-electric and electro-dynamic type. Of these, capacitive type transducers are distinguished by their sensitivity, their bandwidth, their stability and their low consumption and they are generally used in hearing aids on account of these favourable properties.

Although these capacitive transducers operate in a satisfactory manner, they have the disadvantage of requiring the use of an external polarization which has to be relatively high, for example of the order of several tens or several hundreds of volts.

Electret capacitive transducers have been suggested to overcome this inconvenience. These transducers, which currently dominate the market for application in hearing aids with more than 3 million units sold annually, are characterised in that they do not need external polarization in order to work.

Electrical charges trapped in a quasi-permanent manner in a layer of dielectric material on one of the electrodes of the transducer are sufficient to supply the polarization voltage needed for its operation.

Transducers of this type may also be made of silicon in relatively small dimensions which make it possible for the hearing aids in which they are used to be easily miniaturised so as to be easily placed in the ear. Transducers used in hearing aids currently on the market typically have dimensions of the order of $3.6\times3.6\times2.3$ mm$^3$.

However, the manufacture of these electret capacitive transducers presents a number of problems.

Conventional electrets, which are generally formed in films of TEFLON (PTFE), have the disadvantage of discharging, notably as time goes on. This discharging process, which increases with temperature and humidity, reduces the sensitivity of the transducer and affects its life time.

Under the circumstances it is necessary to use a layer of TEFLON measuring some 12 micrometers which reduces the general performance of the transducer and increases in disadvantageous manner the thickness of the transducer assembly.

In addition, since TEFLON does not withstand high temperatures, electrets made of this material are poorly compatible with the silicon technology used in manufacturing the remaining structure of the transducer.

A different, so-called hybrid, approach is described in the publication entitled "Development of an electret microphone in silicon" by A. J. Sprenkels et al., in the journal Sensors and Actuators, 17(1989), pages 509–512.

In this publication, the electret capacitive transducer comprises a rigid silicon base manufactured using techniques analogous to those used in the manufacture of semiconductor devices and associated with a MYLAR (PETP) sheet which forms the membrane of the transducer. The electret is formed of a layer of $SiO_2$, formed starting from the base and facing the membrane in which the charges have been implanted.

This approach nevertheless still has disadvantages.

Because the layer of $SiO_2$ is insulating, the electret must be charged before the membrane is mounted on the base. Moreover, this charge has to be made using expensive implantation techniques, such as Corona implantation or electron beam implantation.

In addition, the need to charge the electret before the membrane is mounted on the base limits the choice of manufacturing techniques that can be used after this charging stage if this charge is not to deteriorate. In particular, the bonding of the membrane to the base must be effected at low temperature, for example, using an epoxy adhesive.

It has, moreover, been found that an electret formed in this manner discharges rapidly, with the result that it Us necessary to treat the surface with $SiO_2$, for example by silanisation, so as to reduce the surface conduction and thereby increase the retention of charges in the layer of $SiO_2$. However, apart from the increase in the cost of carrying out this treatment, the result of the latter remains not very effective because of its instability with time.

In addition, to uniformly charge the two above-mentioned types of electret it is necessary to use charging installations able to sweep the surface of the electret. Here, too, putting these installations into operation is expensive and is an additional restriction to manufacture which is best eliminated.

Finally, the charge of the types of electret mentioned hereinabove can be neither modified nor controlled after its manufacture, as a result of which the life of the electret is limited, bearing in mind the inevitable losses in charge in the course of time.

SUMMARY OF THE INVENTION

It is thus a main object of the invention to overcome the disadvantages of the above-mentioned prior art by providing a capacitive transducer with integrated electret which exhibits an electret structure capable of being electrically charged in homogenous and simple manner with good charge retention properties, the state of charge of which can be accurately controlled, both during and after manufacture of the transducer.

The transducer of the invention can be recharged if required with the result that its life is considerably extended compared to electret transducers of the state of the art.

It is another object of the invention to provide an electret transducer capable of being produced by using complementary micromechanical and microelectronic technologies.

The object of the invention is thus an integrated capacitive transducer comprising:

a membrane having a movable part provided with an electrode, a fixed plate having a counter-electrode, an electrode and counter-electrode support structure, said fixed plate also comprising an electret which is disposed facing said movable part and being separated from said membrane by an open space; said transducer being characterised in that said electret has a conductive layer embedded in an insulating material.

The charges introduced in the conductive layer thus distribute themselves therein in homogenous manner. The conductive layer embedded in an insulating material has good charge retention properties.

BRIEF DESCRIPTION OF THE DRAWINGS

Other features and advantages of the invention will emerge clearly from study of the following description of an embodiment of the transducer given by way of nonlimiting example and in association with the appended drawings in which.

DETAILED DESCRIPTION OF THE INVENTION

Figure 1:
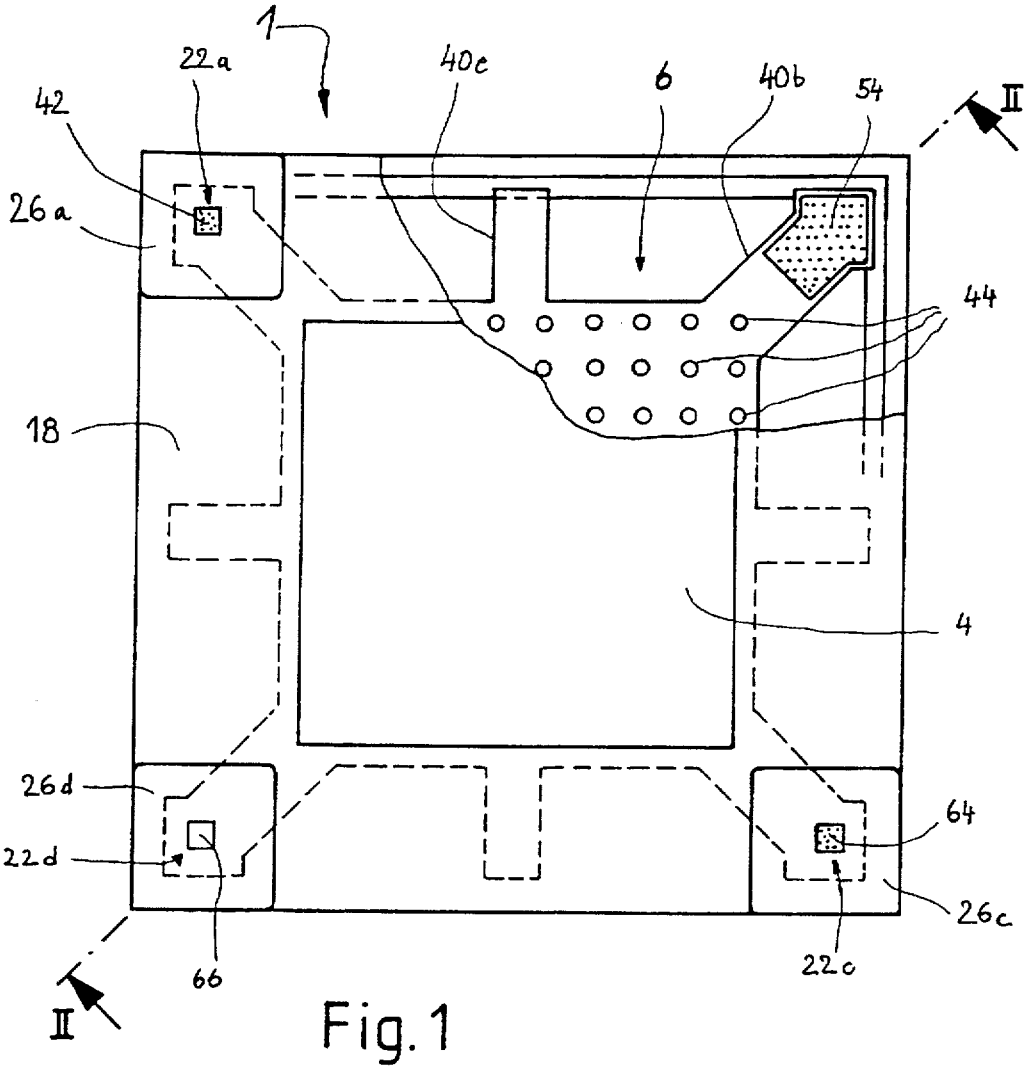
FIG. 1 is a diagrammatic, partially exploded plan view of the capacitive transducer with integrated electret of the invention.

Reference now being made to FIG. 1, this shows a partially exploded plan view of an integrated capacitive transducer of the invention which is designated with the general reference numeral 1. FIG. 1 will be better understood by referring simultaneously to FIG. 2.

The capacitive transducer 1 generally comprises an upper plate 2 having a first electrode 4, an intermediate plate 6 having a second fixed electrode 8 (FIG. 3) and a lower plate 10 forming, on the one hand, a support structure for the whole formed of two plates 2 and 6 and, on the other hand, a rear chamber 12 of the transducer.

The intermediate plate 6 is fixed by means of an insulating spacer 14 to the upper plate 2 which is, in turn, fixed by means of its periphery to the support structure 10. The spacer 14 separates the upper plate 2 from the intermediate plate 6 by providing an open space 16 between the two plates 2 and 6, and electrically insulates the plates 2 and 6 from one another.

The structure comprising the plates 2 and 6, having the electrodes 4 and 8, thus forms the capacitive element of the transducer 1.

The upper plate 2 has a frame 18 with the electrode 4 extending into the interior thereof. This electrode is composed of a thin foil which is connected to the frame 18 by an inner edge 20. The electrode 4 thus forms the movable part or membrane of the transducer 1.

In the embodiment described herein, the frame 18 and the electrode 4 advantageously exhibit a monolithic structure and are made of a semiconductor material such as silicon.

It will be noted in passing that this monolithic structure advantageously reduces the sensitivity to temperature variations, thus increasing the reliability of the transducer.

It goes without saying that, according to an embodiment of the invention, the frame 18 and the transducer membrane can be made of a single part and that the electrode 4 can be mounted on the membrane. In this case, the materials used for the frame and the membrane are not necessarily electrically conductive.

The upper plate 2 also comprises contact windows 22*a*–22*d* provided in the corners of the frame 18 to establish electrical contacts with the elements (described hereinafter) of the intermediate plate 6. The edges of these contact windows 22*a*–22*d* are covered with a layer of insulating material 26*a*–26*d*.

Reference will now be also made to FIGS. 3 to 6 for the description of the intermediate plate 6.

The intermediate plate 6 also comprises, apart from the electrode 8, an electret 30 having a first electrically conductive layer 32 embedded between two layers 34, 36 of an insulating material. The electret 30 extends substantially facing the membrane 4 of the upper plate 2.

More specifically, the plate 6 has a substrate 38 on the surface of which there is a second electrically conductive layer constituting the second fixed electrode 8. In the example shown in the figures, the electret 30 is disposed on the surface of the second electrode 8.

In the following description, the layer of insulating material 34 in direct contact with the second electrode 8 will be termed the first insulating layer 34 and the layer of insulating material 36 extending facing the movable part 4 will be termed the second insulating layer 36.

Figure 3:
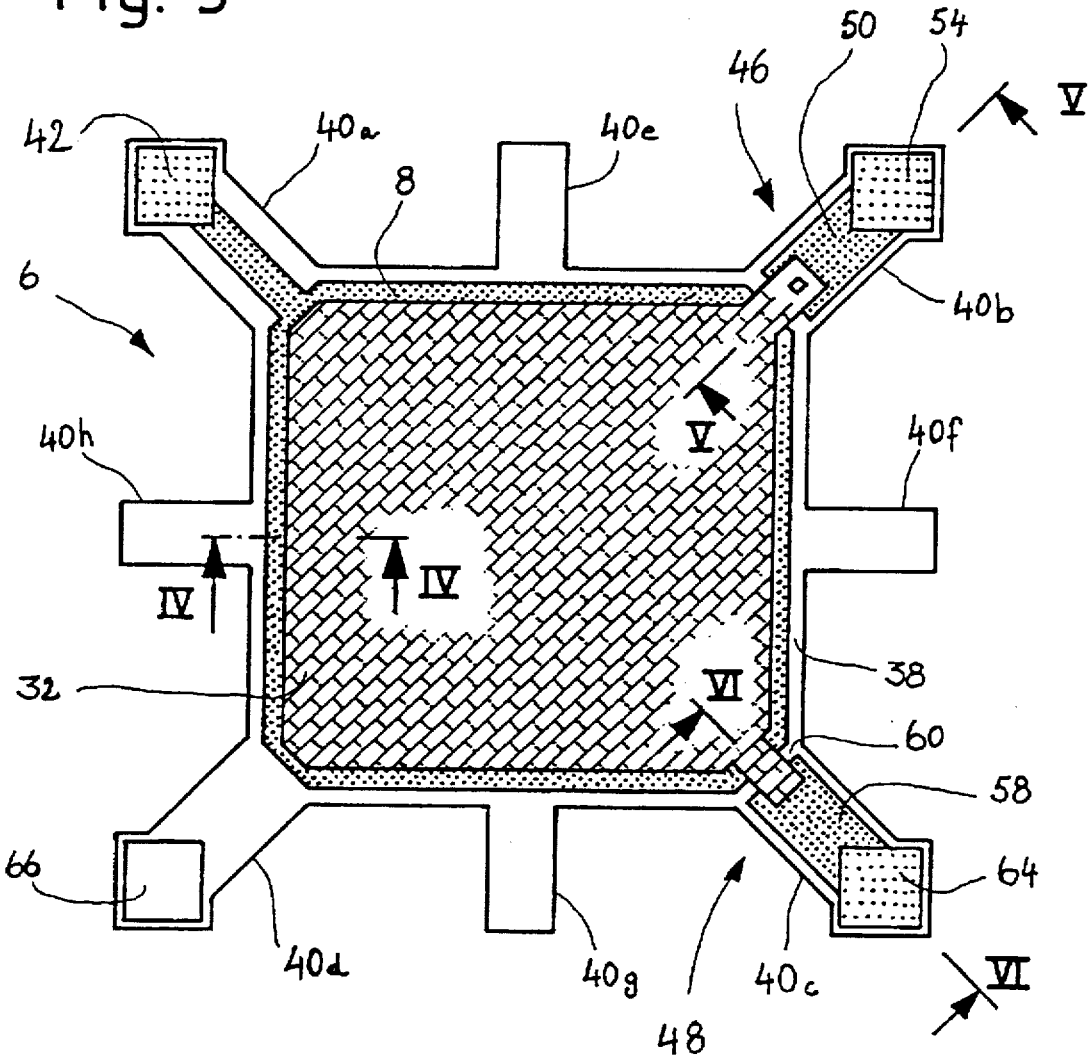
FIG. 3 is a diagrammatic plan view of the fixed plate provided with an electret and constituting a counter-electrode in which the holes and the upper layer of insulation have been omitted.
Figure 4:
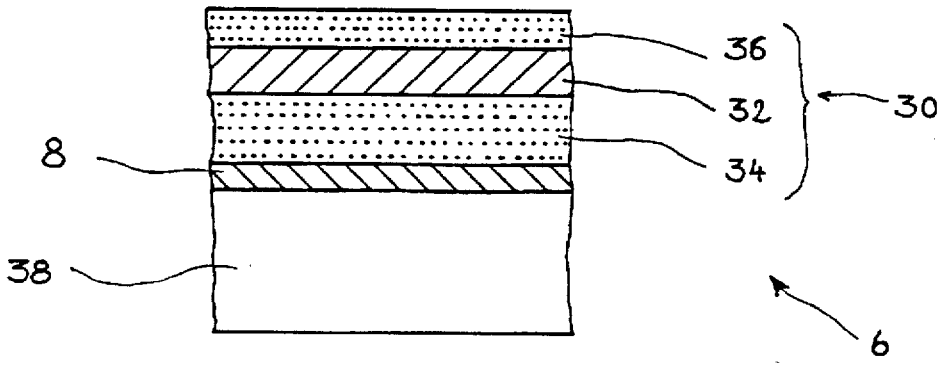
FIG. 4 is an enlarged partially diagrammatic section along the line IV—IV of FIG. 3 of the fixed plate constituting a counter-electrode provided with the electret with the upper insulating layer.

As emerges in particular from FIGS. 1 and 3, it may be seen that the intermediate plate 6 is connected to the upper plate 2 by a plurality of arms 40*a*–40*h* extending from the plate 6, the extremity of which is facing the frame 18 to which they are fixed by the intermediary of the spacers 14.

In the example described herein, the arms 40*a*–40*h* are formed by extensions of the substrate 38 which extend respectively from the four corners of the plate 6 and from the middle of the sides of the plate 6.

It will be noted that this structure for fixing the intermediate plate 6 to the upper plate by means of arms helps to increase the sensitivity of the transducer 1 by reducing to a minimum the parasitic capacitance formed by the parts of the fixed plate located close to the frame 18. By way of example, a structure of this kind connected to a membrane 4 having a thickness of the order of $3.65\times10^{-6}$ m makes it possible to achieve a sensitivity greater than 10 mv/Pa.

It will also be noted in this connection that the second conductive layer or electrode 8 extends on the surface of one arm 40*a* to form at its extremity a contact surface 42 of the electrode 8 with the exterior. This surface 42 is of course not covered with insulating layers 34 and 36 and is located facing the contact window 22*a*.

By way of example, the substrate 38 is made of slightly doped silicon p presenting a surface orientation <100>, the second conductive layer 8 is formed by a doped region n+, the first and second insulating layers 34 and 36 are made of silicon oxide and the first conductive layer 32 is made of doped polysilicon.

Figure 2:
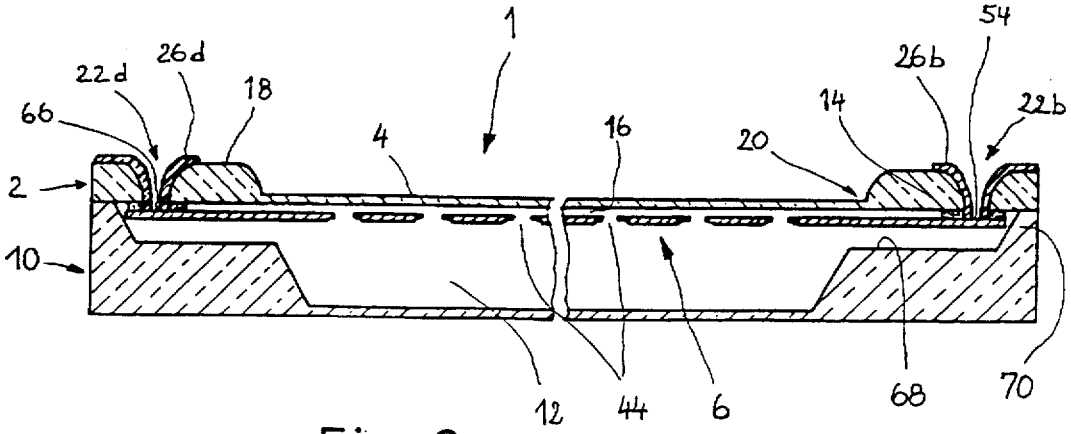
FIG. 2 is a diagrammatic section along the line II—II of FIG. 1.

As emerges clearly from FIGS. 1 and 2, the plate 6 also comprises, in its zone facing the electrode or mobile part 4, a plurality of through holes 44 regularly distributed in lines and in columns. These holes 44 reduce the acoustic resistance between the membrane 4 and the plate 6 and deliver, in combination with the open space 16, a damping device of the acoustic structure of the transducer 1, substantially improving the acoustic properties of this latter. It is, in fact, possible to adjust the response in frequency, for example the bandwidth, of the transducer by judicious positioning of these holes.

Figure 5:
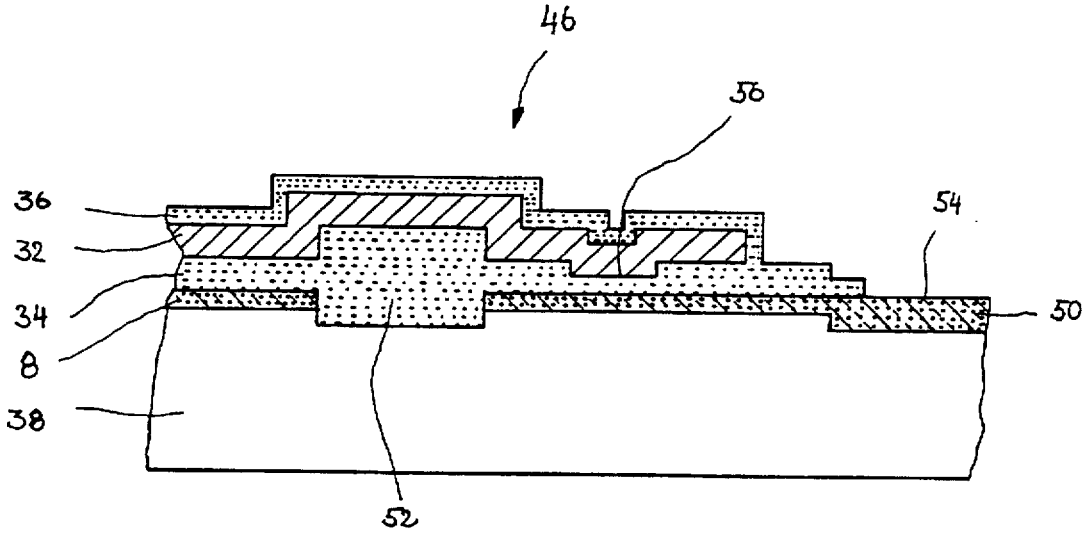
FIG. 5 is an enlarged partially diagrammatic section along the line V—V of FIG. 3 of the means for injecting charges into the electrode with the upper insulating layer.
Figure 6:
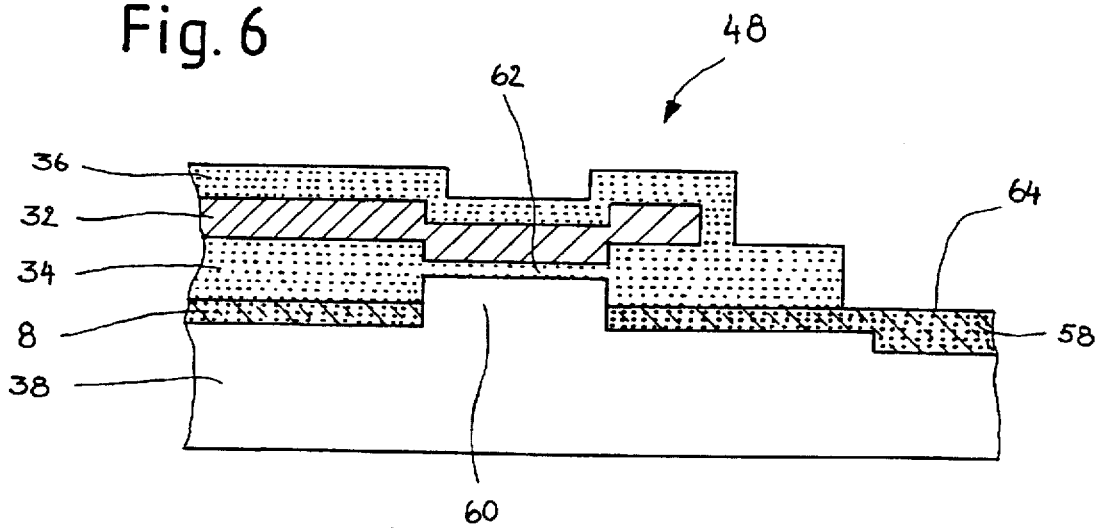
FIG. 6 is an enlarged partially diagrammatic section along the line VI—VI of FIG. 3 of the control means of the state of charge of the electret with the upper insulating layer.

The intermediate plate 6 also comprises charging means 46 and control means 48 of the electret charge 30. Reference will be made in particular to FIGS. 3, 5 and 6 in describing these means 46 and 48.

It will be noted that the insulating layers 34 and 36 have been omitted from FIG. 3 for reasons of clarity.

The charging means 46 of the electret 30 comprise a third electrically conductive layer 50 disposed on the surface of the substrate 38. The layer 50 extends on the arm **40*b* and is insulated from the second electrode 8 by a thickened part 52 of the first insulating layer 34. The first insulating layer 34 is extended and covers part of the layer 50; the uncovered part of this latter constitutes a contact surface 54 which is disposed facing the contact window 22*b* of the frame 18. The first conductive layer 32 as well as the second insulating layer 36 also extend above the layer 50. Into this extension there is provided an injection zone 56 in which the thickness of the first insulating layer 34 between the conductive layers 32 and 50** is small.

Thus, in order to charge the electret 30 it is sufficient to apply a voltage between the contact surfaces 42 (connected to the counter-electrode 8) and 54 in order to inject charges into the polysilicon layer 32 through the thin oxide injection zone 56.

The injection will be facilitated if the ratio between the capacitance, which is formed by the counter-electrode 8, the first insulating layer 34 and the conductive layer 32 and the capacitance, which is formed by the conductive layer 50, said first insulating layer 34 and the conductive layer 32, is large.

This mechanism of injecting charges through a thin oxide is termed the Fowler-Nordheim type and is notably described in the publication JOURNAL OF APPLIED PHYSICS, VOLUME 40, NUMBER 1 JANUARY 1969, entitled "Fowler-Nordheim Tunneling into Thermally Grown $SiO_2$" by M. Lenzlinger and E. H. Snow.

By means of the structure of the transducer described, the mechanism of charging the electret 30 is simpler than in the structures of the prior art and the charge can be easily controlled and possibly adjusted afterwards in order to obtain the desired density of charges. Moreover, the charges distribute themselves uniformly in the insulated conductive layer 32. These charge means also simplify the complete manufacturing process of the transducer by making it possible to charge the electret as the very last operation so that one can carry out the humid and high temperature stages of the process without having to take any possible discharge of the electret into consideration.

The control means of the charge 48 of the electret 30 comprise a fourth electrically conductive layer 58 disposed at the surface of the substrate 38. The layer 58 extends on the arm **40*c* and is insulated from the second electrode 8 by a thickened zone 60 of the substrate 38. At the level of this thickened zone 60, the substrate 38 is separated from the conductive layer 32 by a part of smaller thickness 62 of the first insulating layer 34. The first insulating layer 34 extends and covers part of the layer 58 and leaves a contact surface 64 (disposed facing the contact window 20*c* of the contact frame 18). The first conductive layer 32 as well as the second insulating layer 36 also cover part of the layer 58 in such a way that the conductive layer 32, forming the part which retains the charges of the electret 30, extends at least above the part of lesser thickness 62** and is completely insulated from the outside.

The structure of the control means of the charge 48 thus form a field effect transistor in which the source is formed by the conductive layer 8, the drain is formed by the conductive layer 58 and the gate is formed by the conductive layer 32. The source-drain current being a function, inter alia, of the charge of the gate (the layer 32), measurement of this current makes it possible to easily determine the state of charge of the electret 30 and to readjust this using the charge means 46 if this is necessary.

It will also be noted that the arm **40*d* comprises a part of substrate not covered by the insulating layers 34 and 36 forms a contact surface 66 which extends facing the contact window 20*d* and which makes it possible to monitor and fix the potential of the substrate 38**.

The lower plate 10 forming the support means of the capacitive element of the transducer 1 comprises an element generally planar in shape and on one face of which a cavity has been provided forming a rear chamber 12 which is disposed facing the intermediate plate 6. The cavity 12 comprises a thickened zone 68 which extends at its periphery substantially facing the frame 18 of the plate 6 and thus delimits an edge or rib 70 by which the lower plate 10 is connected to the upper plate 2. The plate 10 exhibits a monolithic structure and, in common with the frame 18, is made of a semiconductor material such as silicon. The plate 10 can be fixed to the frame 18 by simple silicon-silicon bonding.

For purpose of clarity, the transducer of the invention has the general dimensions $2.3\times2.3\times1.0$ mm$^3$. The surface of the mobile part is $2.0\times2.0$ mm$^2$, the thickness of the membrane is about $3.65\times10^{-6}$ m, the thickness of the intermediate plate 6 is about $10\times10^{-6}$ m, the thickness of the air film in the open space 14 is about $3\times10^{-6}$ m, and the internal volume delimited by the cavity 11 is about 5 mm$^3$. The holes have a diameter of about $30\times10^{-6}$ m and number about 400 per mm$^2$ with the result that they occupy about 28% of the surface of the membrane.

We claim:

1. An integrated capacitive electroacoustic transducer comprising:

a membrane having a movable part provided with an electrode, a fixed plate having a counter-electrode and separated from said membrane by an open space, and a support structure for the electrode and counter-electrode, said membrane, said fixed plate and said support structure being arranged to provide an acoustic structure, said fixed plate having in addition to said counter-electrode a first distinct layer of an electrically conductive material or a doped semi-conductive material which is disposed between said counter-electrode and said open space, which is isolated from direct electrical conduction by being fully surrounded by and embedded between two layers of an insulating material, and which is arranged to be charged through at least a portion of said insulating material, and wherein said transducer further comprises charging means for said first distinct layer integrated within said fixed plate, wherein said fixed plate has a substrate, wherein said counter-electrode comprises a second electrically conductive layer disposed on a face of said substrate, wherein said first distinct layer is disposed between a layer of insulating material in contact with the counter-electrode termed the first insulating layer and a layer of insulating material facing the membrane termed the second insulating layer, and wherein said charging means includes a third layer of electrically conductive material which is disposed at the surface of said substrate and which is isolated from said counter-electrode by a thickening of the first insulating layer and a zone of lesser thickness provided in said first insulating layer.

2. A transducer according to claim 1 further comprising control means integrated within said fixed plate for controlling the state of charge of said first distinct layer.

3. A transducer according to claim 2 wherein the control means comprises a fourth layer of electrically conductive material which is disposed at the surface of said substrate and isolated from said counter-electrode by a thickened zone of said substrate.

4. A transducer according to claim 3 wherein said fixed plate is connected to the membrane by a plurality of suspension arm extending from said fixed plate.

5. A transducer according to claim 4 wherein the second, third and fourth conductive layers each extends at least along a corresponding one of the suspension arms of said fixed plate.

6. A tranducer according to claim 5 wherein the membrane is connected to a frame comprising contact windows for establishing a contact isolated from the electrode, and wherein said fixed plate is fixed to said frame by said suspension arms and a plurality of insulating spacers.

7. A transducer according to claim 6 wherein the contact windows are disposed facing said suspension arms having the second, third and fourth conductive layers.

8. A transducer according to claim 7 wherein one of said contact windows faces one of a said suspension arms to establish contact with the substrate.

9. A transducer according to claim 6 wherein one of said contact windows faces one of said suspension arms to establish contact with the substrate.

10. A transducer according to claim 6 wherein the membrane and the frame exhibit a monolithic structure.

11. A transducer according to claim 6 wherein said support structure comprises a planar element provided with a cavity facing said fixed plate, and wherein the edges of said planar element are fixed to the periphery of the membrane.

12. A transducer according to claim 11 wherein said cavity comprises a shoulder extending along a peripheral portion of said planar element to substantially face said frame.

13. A transducer according to claim 4 wherein the membrane is connected to a frame comprising contact windows for establishing a contact isolated from the electrode, and wherein said fixed plate is fixed to said frame by said suspension arms and a plurality of insulating spacers.

14. A transducer according to claim 13 wherein said support structure comprises a planar element provided with a cavity facing said fixed plate, and wherein the edges of said planar element are fixed to the periphery of the membrane.

15. A transducer according to claim 14 wherein said cavity comprises a shoulder extending along a peripheral portion of said planar element to substantially face said frame.

16. A transducer according to claim 1 wherein said fixed plate comprises a plurality of through holes regularly distributed over the fixed plate.

* * * * *